United States Patent [19]

Mueller

[11] 3,993,124

[45] Nov. 23, 1976

[54] METHOD AND APPARATUS FOR FUSER ASSEMBLY COOLING IN AN ELECTROSTATOGRAPHIC MACHINE

[75] Inventor: Karl Mueller, Fairport, N.Y.

[73] Assignee: Xerox Corporation, Stamford, Conn.

[22] Filed: Dec. 30, 1971

[21] Appl. No.: 214,305

[52] U.S. Cl. ..... 165/89; 355/35; 355/109; 355/110

[51] Int. Cl.[2] ..... F28D 11/02

[58] Field of Search ..... 165/89, 134, 105; 355/30, 108, 109, 110

[56] References Cited

UNITED STATES PATENTS

| | | | |
|---|---|---|---|
| 2,260,486 | 10/1941 | Schmeck | 355/110 |
| 2,311,849 | 2/1943 | MacDonald | 355/110 |
| 2,692,118 | 10/1954 | Holloway | 165/134 |
| 2,726,588 | 12/1955 | Wasteels | 355/109 |
| 3,329,076 | 7/1967 | Bishop | 355/110 |
| 3,517,997 | 6/1970 | Ghiselli | 355/30 |
| 3,561,868 | 2/1971 | Ritzerfeld | 355/30 |
| 3,816,066 | 6/1974 | Thettu | 165/105 |

FOREIGN PATENTS OR APPLICATIONS

| | | | |
|---|---|---|---|
| 2,112,542 | 9/1972 | Germany | 355/30 |
| 57,837 | 1/1946 | Netherlands | 355/110 |

*Primary Examiner*—Charles J. Myhre
*Assistant Examiner*—Daniel J. O'Connor

[57] ABSTRACT

A heat transfer assembly is provided having heat transfer elements which contact end portions of a pressure roller of a fuser assembly. A heat transfer fluid is caused to pass over the elements in response to a signal to remove heat therefrom thereby cooling such portions of the pressure roller in contact with the elements.

6 Claims, 4 Drawing Figures

METHOD AND APPARATUS FOR FUSER ASSEMBLY COOLING IN AN ELECTROSTATOGRAPHIC MACHINE

BACKGROUND OF THE INVENTION

This invention relates to electrostatography, and more particularly to a method and apparatus for removing heat from the pressure roller of the fuser assembly of an electrostatographic apparatus.

In the practice of xerography as described in U.S. Pat. No. 2,297,691 to Chester F. Carlson, a xerographic surface comprising a layer of photoconductive insulating material affixed to a conductive backing is used to support electrostatic images. In the usual method of carrying out the process, the xerographic plate is electrostatically charged uniformly over its surface and then exposed to a light pattern of the image being reproduced to thereby discharge the charge in the areas where light strikes the layer. The undischarged areas of the layer thus form an electrostatic charge pattern in conformity with the configuration of the original light pattern.

The latent electrostatic image may then be developed by contacting it with a finely divided electrostatically attractable material, such as a resinous powder. The powder is held in the image areas by the electrostatic fields on the layer. Where the field is greatest, the greatest amount of material is deposited; and where the field is least, little or no material is deposited. Thus, a powder image is produced in conformity with the light image of the copy being reproduced. The powder is subsequently transferred to a sheet of paper or other surface and suitably affixed to thereby form a permanent print.

The toner may be fixed by passing the sheet of paper or other surface including the transferred image between a heated roller and a second roller in pressure contact therewith whereby the toner becomes fused to the sheet of paper. In accordance with such techniques, the temperature to which the toner is generally raised is a temperature (for a given pressure) at which the toner particles coalesce or flow together and wet the paper surface to effect thereby a permanent bond. The heated or fuser roller is generally a sleeve formed of a heat conductive material, for example, copper, whereas the contact or pressure roller is a sleeve having a thick outer layer of a resilient material, such as rubber coated with a protective layer of a heat resistant material, e.g., Teflon (available from Du Pont). When the two rollers are placed in pressure contact, a nip of sufficient width is developed to fix efficaciously the toner to the image receiving member. In the electrostatographic machine hereinafter described, the image receiving member on which the developed electrostatographic image is to be transferred, such as paper, is passed through the fusing zone sideways as compared to lengthwise as in most prior devices, i.e. line copy is perpendicular to the axis of the rollers. The temperature to which the heated or fuser roller is raised is sufficiently high to effect deleteriously any portion of the pressure roller which is in continuous contact with the heated fuser roller (i.e. end portions of the pressure roller where image receiving members being processed are of a dimension less than the designed maximum dimension therefor), there being sufficient heat removal in those areas wherein image receiving members are in contact with the rollers.

OBJECTS OF THE INVENTION

An object of this invention is to provide a novel fuser assembly.

Another object of this invention is to provide a novel method and apparatus for removing heat from the pressure roller of a fuser assembly.

A further object of the invention is to provide a novel method and apparatus for extending the operational life of a pressure roller of a fuser assembly.

SUMMARY OF THE INVENTION

These and other objects of the invention are obtained by providing a heat transfer assembly including heat transfer means which contacts the pressure roller to remove heat therefrom by the passage of a heat transfer fluid about the assembly in response to a signal during operation of the machine. In this manner the temperature of the fuser roller may be maintained at a temperature sufficient (at a given pressure) to cause the toner to wet the surface of the paper image receiving members being processed, however cooling portions of the pressure roller in contact with the heat transfer means to minimize the effect of high temperatures on portions of the pressure roller not subjected to the passage of image receiving members therethrough.

DESCRIPTION OF THE DRAWINGS

A better understanding of the present invention as well as other objects and further features thereof will become apparent upon consideration of the following detailed disclosure thereof, especially when taken with the accompanying drawings, wherein like numerals designate like parts throughout.

Figure 1:
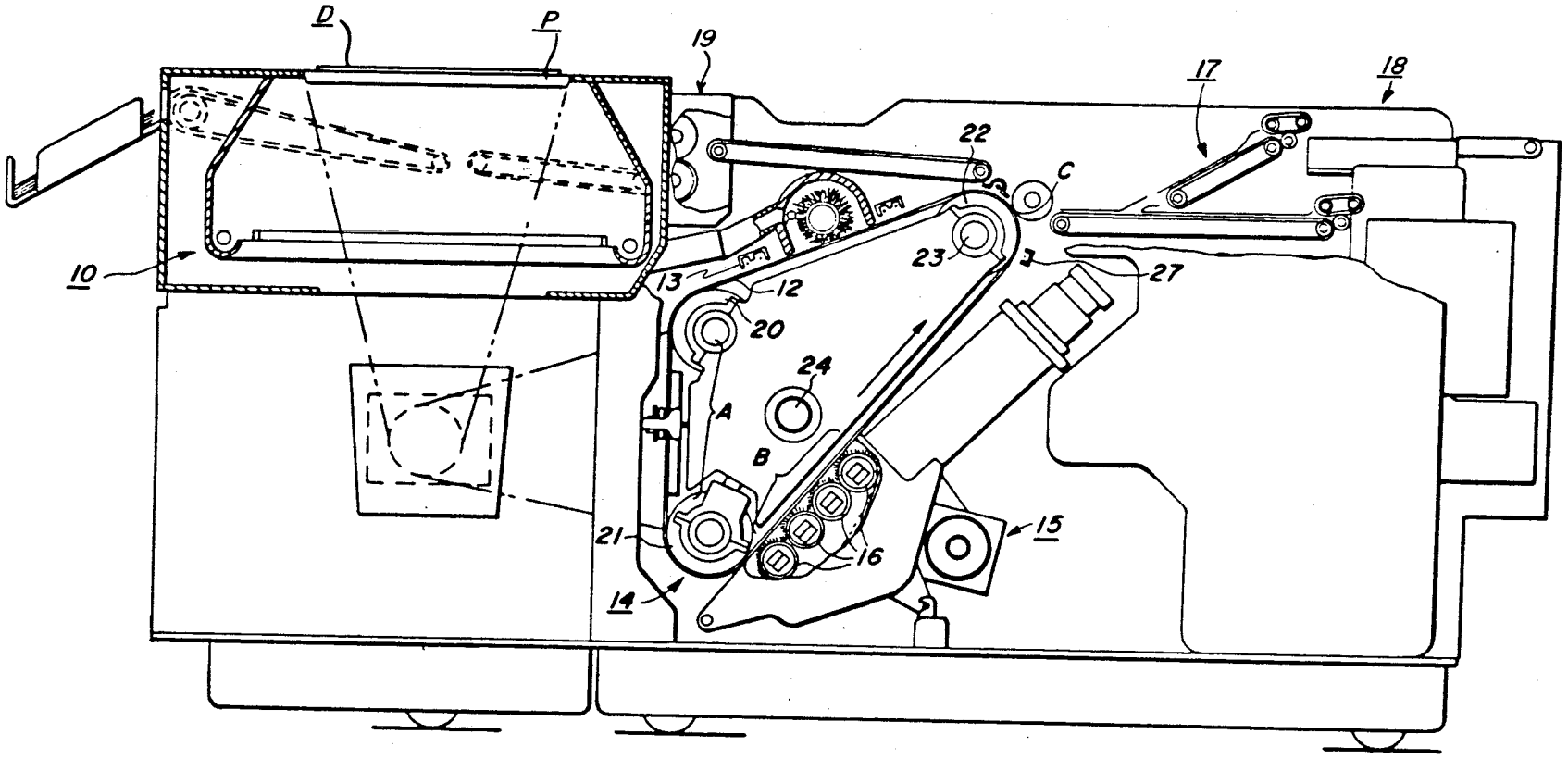
FIG. 1 is a schematic sectional view of an electrostatic reproduction machine embodying the principles of the invention.

For a general understanding of the illustrated copier/reproduction machine in which the invention may be incorporated, reference is had to FIG. 1 in which the various system components for the machine are schematically illustrated.

A document D to be copied is placed upon a transparent support platen P fixedly arranged in an illumination assembly, generally indicated by the reference numeral 10, positioned at the left end of the machine. Light rays from an illumination system are flashed upon the document to produce image rays corresponding to the informational areas. The image rays are projected by means of an optical system onto the photosensitive surface of a xerographic plate in the form of a flexible photoconductive belt 12 arranged on a belt assembly, generally indicated by the reference numeral 14.

The belt 12 comprises a photoconductive layer of selenium which is the light receiving surface and imaging medium for the apparatus, on a conductive backing. The surface of the photoconductive belt is made photosensitive by a previous step of uniformly charging the same by means of a corona generating device or corotron 13.

The belt is journaled for continuous movement upon three rollers 20, 21 and 22 positioned with their axes in parallel. The photoconductive belt assembly 14 is slidably mounted upon two support shafts 23 and 24 with the roller 22 rotatably supported on the shaft 23 which is secured to the frame of the apparatus and is rotatably driven by a suitable motor and drive assembly (not shown) in the direction of the arrow at a constant rate. During exposure of the belt 12, the portion exposed is that portion of the belt running between rollers 20 and 21. During such movement of the belt 12, the reflected light image of such original document positioned on the platen is flashed on the surface of the belt to produce an electrostatic latent image thereon at exposure station A.

As the belt surface continues its movement, the electrostatic image passes through a developing station B in which there is positioned a developer assembly generally indicated by the reference numeral 15, and which provides development of the electrostatic image by means of multiple brushes 16 as the same moves through the development zone.

The developed electrostatic image is transported by the belt to a transfer station C whereat a sheet of copy paper is moved between a transfer roller and the belt at a speed in synchronism with the moving belt in order to accomplish transfer of the developed image solely by an electrical bias on the transfer roller. There is provided at this station a sheet transport mechanism generally indicated at 17 adapted to transport sheets of paper from a paper handling mechanism generally indicated by the reference numeral 18 to the developed image on the belt at the station C.

After the sheet is stripped from the belt 12, it is conveyed into a fuser assembly, generally indicated by the reference numeral 19, wherein the developed and transferred xerographic powder image on the sheet material is permanently affixed thereto. After fusing, the finished copy is discharged from the apparatus at a suitable point for collection externally of the apparatus.

Further details regarding the structure of the belt assembly 14 and its relationship with the machine and support therefor may be found in the copending application Ser. No. 102,312, assigned to the same assignee.

Figure 2:
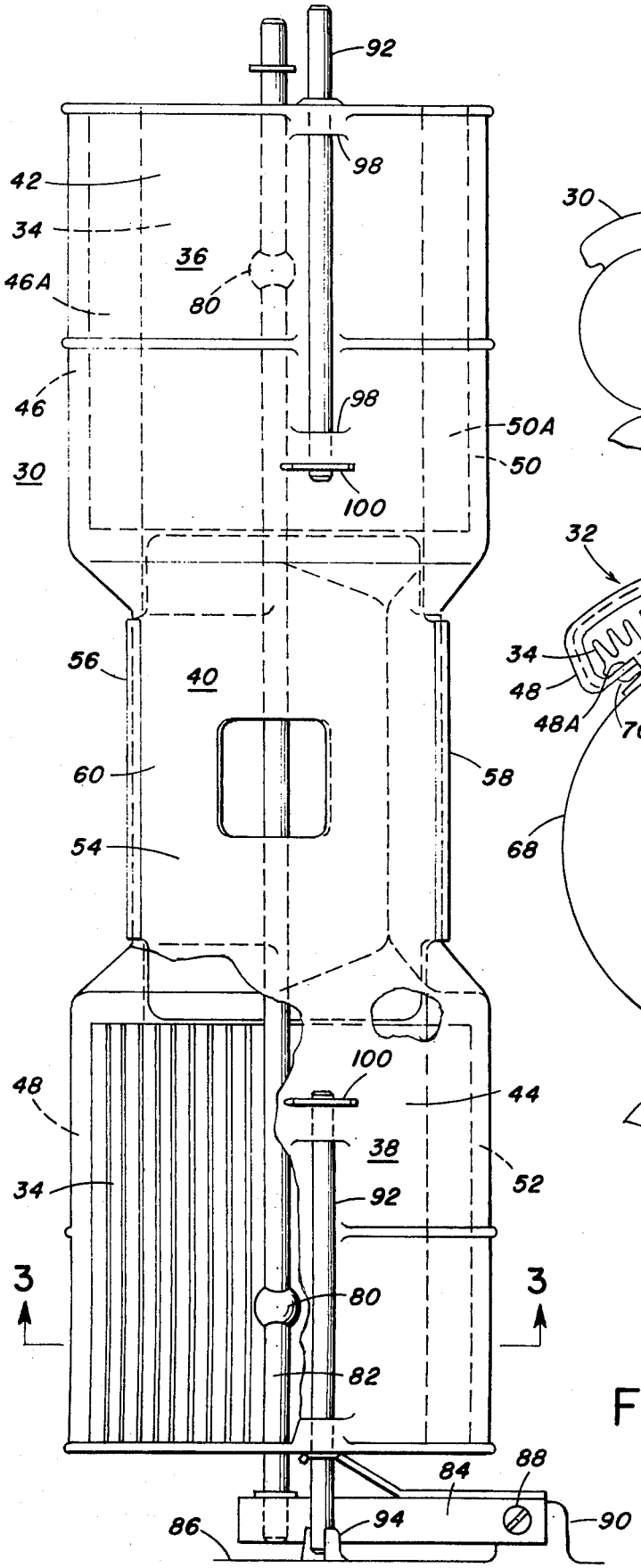
FIG. 2 is a plane view of the heat transfer assembly partially cut away to illustrate the configuration of the heat transfer means.

Referring now to FIG. 2, there is provided a heat transfer assembly, generally indicated as 30 (which is positioned at 19 of the machine in FIG. 1), comprised of a cover, generally indicated as 32, and heat transfer elements, generally indicated as 34. The cover 32 may be formed of one piece construction and, as illustrated, is formed of side sections, generally indicated as 36 and 38, and an intermediate section, generally indicated as 40. The side sections 36 and 38 are formed of top walls 42 and 44, front walls 46 and 48, and back walls 50 and 52, respectively. The intermediate section 40 is formed of a top wall 54, a front wall 56 and a back wall 58. The top wall 54 of the intermediate section 40 is provided with an orifice 60 to provide a conduit means for a heat transfer fluid, as more fully hereinbelow discussed. The end portions of the side sections 36 and 38 opposite the intermediate section 40 are essentially unobstructive to provide an inlet means for the heat transfer fluid. The front walls 46 and 48, and back walls 50 and 52 of the side sections 36 and 38, respectively, are provided with inwardly extending tab sections 46A and 48A, and 50A and 52A to provide receiving means for each heat transfer element 34.

Figure 3:
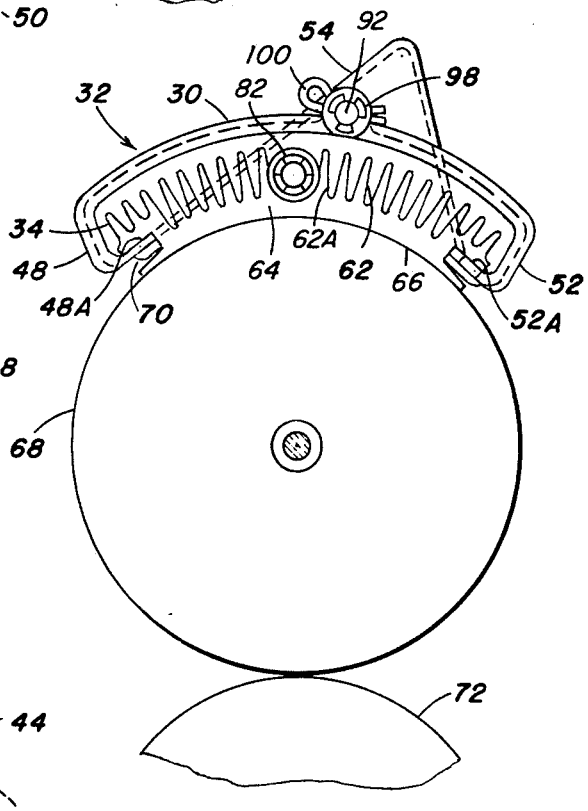
FIG. 3 is a cross-sectional elevational view of the heat transfer assembly taken along the lines 3—3 of FIG. 2.

As illustrated in FIG. 3, a heat transfer element 34 is formed with a plurality of fins 62 extending upwardly from a base 64 thereof, and having an inner cylindrical surface 66 in contact with the cylindrical surface of a pressure roller 68 of the fuser assembly 19 of the machine. The end portions of the base 64 of a heat transfer element 34 are provided with slotted sections 70 which slidably engage the tab sections 46A and 48A, and 50A and 52A of the side sections 36 and 38 of the cover 32, respectively. The pressure roller 68 contacts a fuser roller 72 as hereinabove described, during the image transfer operation of the machine.

Each heat transfer element 34 is held in place on the pressure roller 68 by two spherical sections 80 provided on a shaft 82 above each element 34 and engaging the elements 34 between an intermediate finned section 62A formed in the elements 34. That portion of the element 34 engaging the spherical section may be dimpled for positive action. The ends of the shaft 82 are positioned in a shaft support means 84 rigidly affixed to an intermediate frame assembly 86 of the electrostatographic machine, such as by a screw 88 threaded into a tab section 90 thereof, it being understood that the opposite end of the shaft 72 is similarly supported. The end sections 36 and 38 of the cover 32 are rigid-ly held in position by shafts 92 disposed in a shaft supporting section 94 formed in the main body portion 96 of the machine and extending through shaft receiving orifices 98 formed in the top walls of the side sections and held in place by securing means, such as by cotter pin 100.

Figure 4:
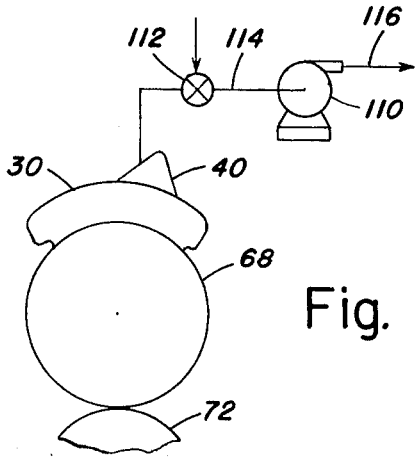
FIG. 4 is a schematic flow diagram of the method of operation of the heat transfer assembly.

In operation (referring now to FIG. 4), a fan 110 is activated on start-up of the machine, but is not placed in fluid communication with the assembly 30 until a sensing means such as disclosed in copending application Ser. No. 214,345, filed Dec. 30, 1971, now U.S. Pat. No. 3,820,591, issued June 28, 1974 responds, for example, to a signal that image receiving members of a dimension less than the maximum designed dimension therefor are being transported through the machine. Such a signal activates a switching device (not shown) which alters the configuration of valve 112 to cause air at ambient temperature to be introduced from the end portion of the side sections 36 and 38 about the fins 62 of the heat transfer elements 34 to remove heat connectively therefrom thereby lowering the temperature of the surface of the pressure roller 68 in contact therewith. The thus heated air is withdrawn through the orifice 60 of the intermediate section 40 and is passed through conduit 114 and vented through conduit 116 to the atmosphere.

It is readily appreciated that the heat transfer assembly of this invention may be easily assembled and disassembled for cleaning. It is to be understood that the positioning of a heat transfer element 34 by the spherical section 80 of the shaft 82 essentially effects a loading of the element 34 at one point thereby permitting the element to work like a universal. It is noted that the slotted sections 70 of an element 34 are dimensioned with respect to the tabs 48A and 52A of side section 38, for example, to provide a clearance therebetween to permit the elements to essentially float during rotation of the pressure roller. While the heat transfer assembly of the invention has been described with the provision for heat transfer elements on either end of the pressure roller, with a reference point for the transport system being the centerline of the image receiving member, it is understood that only one element need be provided of an edge of an image receiving member is the reference point for the transport system. Additionally, a heat transfer assembly may be provided, which in operation is placed in contact with the pressure roller in response to a signal sensing the aforementioned condition, i.e. image receiving members of smaller dimension.

While the instant invention as to its objects and advantages has been described herein as carried in specific embodiments thereof, it is not desired to be limited thereby; but it is intended to cover the invention broadly within the scope of the appended claims.

What is claimed is:

1. In an electrostatographic machine for producing copies, the combination of:

a fuser for fusing the copies, said fuser including a pair of rollers, means supporting said roller pair for rotation with the peripheries of said roller pair in contact whereby said roller pair form a nip between which the copies pass, and means to heat at least one roller of said roller pair;

heat transfer means in heat exchange relation with said fuser; and enclosure means disposed about said heat transfer means to form in cooperation with said heat transfer means a chamber, said enclosure means being provided with inlet and outlet means to permit passage of heat transfer fluid through said chamber.

2. The electrostatographic machine as defined in claim 1 wherein said heat transfer means includes a finned heat transfer element having an inner cylindrical surface for contacting one of said roller pair.

3. The electrostatographic machine as defined in claim 1 in which one of said roller pair comprises a pressure roller, said heat transfer means being in heat exchange relation with said pressure roller.

4. The electrostatographic machine as defined in claim 3 wherein said heat transfer means are disposed on end portions of said pressure roller.

5. The electrostatographic machine as defined in claim 1 including conduit means in fluid communication with said outlet means and fan means for moving heat transfer fluid through said chamber and over said heat transfer means to said outlet means and said conduit means.

6. A heat transfer assembly for a copy producing electrostatographic machine comprising:

a fuser roller, a pressure roller in operative engagement with said fuser roller to form a nip between which copies pass;

heat transfer means contacting said heat transfer assembly;

enclosure means disposed about said heat transfer means and provided with inlet and outlet means, conduit means in fluid communication with said outlet means, fan means operatively coupled to said conduit means for causing a heat transfer fluid to be passed over said heat transfer means, and control means for selectively effecting operation of said fan means in response to the dimensions of the copy to be passed between the fuser and pressure rollers.

* * * * *